US009493966B2

(12) United States Patent
Michielan

(10) Patent No.: US 9,493,966 B2
(45) Date of Patent: Nov. 15, 2016

(54) GATE LOCK

(75) Inventor: Gianni Michielan, Mogliano Veneto (IT)

(73) Assignee: CAME GROUP S.p.A., Dosson di Casier (TV) (IT)

( * ) Notice: Subject to any disclaimer, the term of this patent is extended or adjusted under 35 U.S.C. 154(b) by 519 days.

(21) Appl. No.: 13/885,957

(22) PCT Filed: Nov. 17, 2011

(86) PCT No.: PCT/IB2011/002722

§ 371 (c)(1),
(2), (4) Date: Aug. 6, 2013

(87) PCT Pub. No.: WO2012/066409

PCT Pub. Date: May 24, 2012

(65) Prior Publication Data

US 2013/0305791 A1 Nov. 21, 2013

(30) Foreign Application Priority Data

Nov. 18, 2010 (IT) ..... TO2010A0912

(51) Int. Cl.
*E05B 65/06* (2006.01)
*E05B 65/00* (2006.01)

(52) U.S. Cl.
CPC ..... *E05B 65/0007* (2013.01); *E05Y 2201/214* (2013.01); *E05Y 2201/244* (2013.01); *E05Y 2800/426* (2013.01); *E05Y 2900/40* (2013.01); *Y10T 70/5093* (2015.04)

(58) Field of Classification Search
CPC ..... E05B 65/0007; E05B 65/06; E05B 63/0017; Y10T 70/5093; Y10T 70/5155; Y10T 70/5164; Y10T 70/5168; Y10T 70/55; Y10T 70/531; Y10T 70/5323; Y10T 70/5341; Y10T 70/5199; E05Y 2201/244; E05Y 2900/40; E05Y 2800/426; E05Y 2201/214
USPC ..... 70/91, 93, 94, 101, 125, 127, 130, 134, 70/150; 292/169.13, 169.14, DIG. 13; 16/71; 49/139
See application file for complete search history.

(56) References Cited

U.S. PATENT DOCUMENTS 1,706,486 A * 3/1929 Gasey ..... E05B 15/10 292/164
2,223,495 A * 12/1940 Mook, Jr. ..... E05C 1/16 292/153

(Continued)

FOREIGN PATENT DOCUMENTS

EP 0 748 916 12/1996
EP 0 857 845 8/1998

(Continued)

OTHER PUBLICATIONS

International Search Report for International Application No. PCT/IB2011/002722 mailed Jan. 20, 2012.

*Primary Examiner* — Lloyd Gall
(74) *Attorney, Agent, or Firm* — Merchant & Gould P.C.

(57) ABSTRACT

A gate lock (10) includes a body (11), which in turn includes a latch (12) that can house a key (13) for opening the lock (10) and a stop element (14) having a first configuration of engagement on at least a part of the gate. The lock (10) further includes a slide (17), which slides with respect to the body (11); the stop element (14) is slidably constrained to a guide element.

12 Claims, 6 Drawing Sheets

(56) References Cited

U.S. PATENT DOCUMENTS 2,711,920 A * 6/1955 Farnsworth ..... E05B 55/12 292/169.13
2,770,480 A * 11/1956 Linton ..... E05B 55/12 292/169.13
2,854,270 A * 9/1958 Ward ..... E05B 55/005 292/153
2,995,395 A * 8/1961 Browning ..... E05B 55/12 292/153
RE26,677 E * 10/1969 Russell et al. ..... E05B 59/00 292/169.14
4,389,061 A * 6/1983 Foshee ..... E05B 59/00 292/169.14
6,032,329 A * 3/2000 Casali ..... E05B 65/0007 16/71
7,836,737 B2 * 11/2010 Lin ..... E05B 63/127 292/159
7,836,738 B2 * 11/2010 Tien ..... E05B 13/004 292/169.14
8,534,100 B2 * 9/2013 Tsai ..... E05C 9/1875 292/32
8,997,535 B2 * 4/2015 Jeffries ..... E05C 9/042 70/107

FOREIGN PATENT DOCUMENTS

EP 0 965 717 12/1999
EP 2 022 923 2/2009
EP 2 077 365 7/2009

* cited by examiner 13
11a
X
CRANE

11b
Y
15
51
12
Z

11i 11s
10
51
50

GATE LOCK

This application is a National Stage Application of PCT/IB2011/002722, filed 17 Nov. 2011, which claims benefit of Serial No. TO2010A000912, filed 18 Nov. 2010 in Italy and which applications are incorporated herein by reference. To the extent appropriate, a claim of priority is made to each of the above disclosed applications.

BACKGROUND

The present invention relates to locks, more in particular to a gate lock.

It is known that gates, in particular automatic gates, are fitted with locks that can be unlocked either electrically, through a servo control system, or manually, through a normal key.

Typically an automatic gate is opened by using the servocontrol system; however, the presence of a lock is necessary in the event of a servocontrol system failure, so as to avoid that the gate becomes impossible to be opened and/or closed.

In particular, the possibility of opening an automatic gate lock by means of a key, whether a customized or a three sided one, allows the gate to be opened even in the absence of the electric power required for operating the servocontrol system.

For the above reasons, it is clear that automatic gate locks may be used less than other types of locks; it is therefore important that their components are not easily subject to seizing or sticking.

However, some types of gate locks are known to suffer from the drawback that they may get stuck when the key is turned inside an unlocking latch.

SUMMARY

It is therefore the object of the present invention to disclose a lock for a gate, more specifically for a swing gate, which is free from the above-described drawbacks and which, in particular, is easier to open.

BRIEF DESCRIPTION OF THE DRAWINGS

The invention will now be described with reference to the annexed drawings, which illustrate a non-limiting embodiment thereof, wherein.

DETAILED DESCRIPTION

Figure 2:
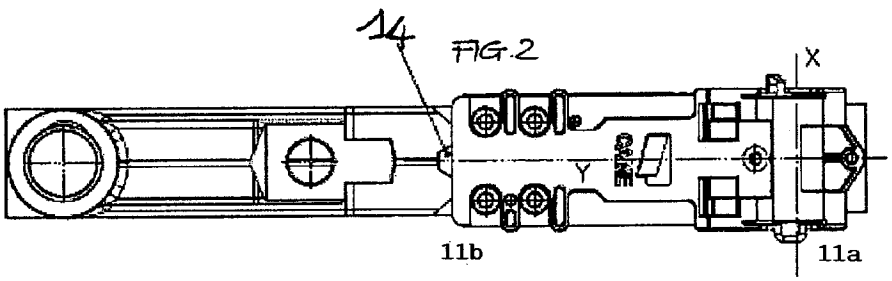
FIGS. 1-3 show a set of views of the drive element-driven element system in a first idle configuration.
Figure 3:
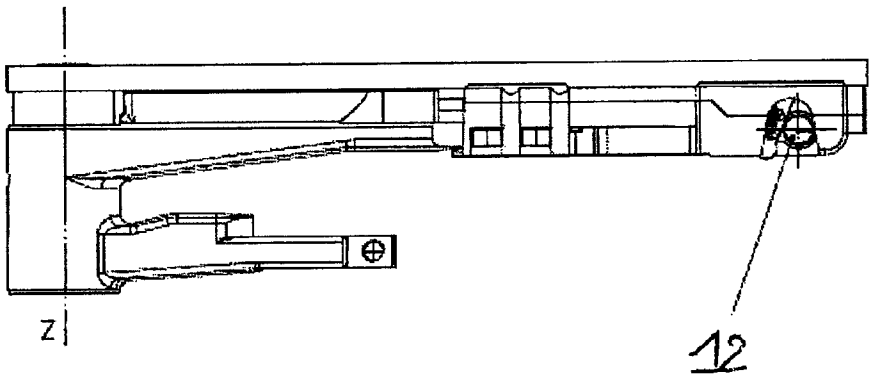
Figure 1:
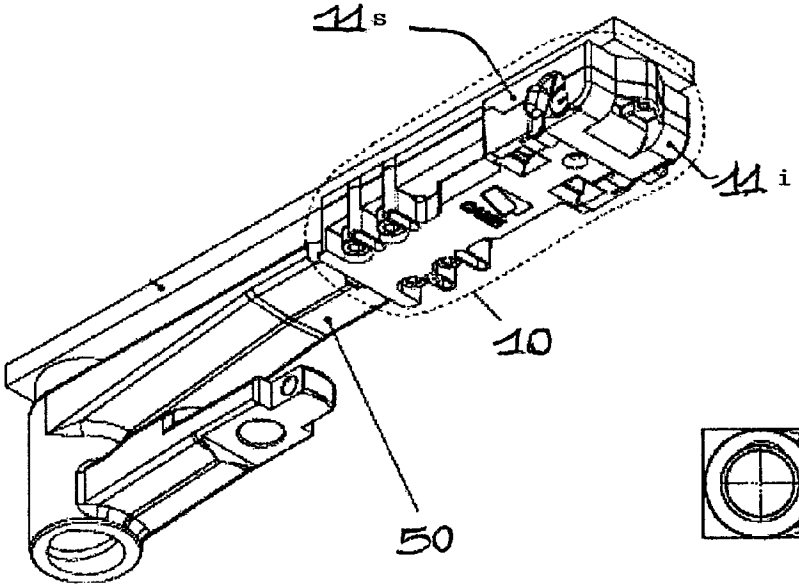
Figures 4, 5, 6:
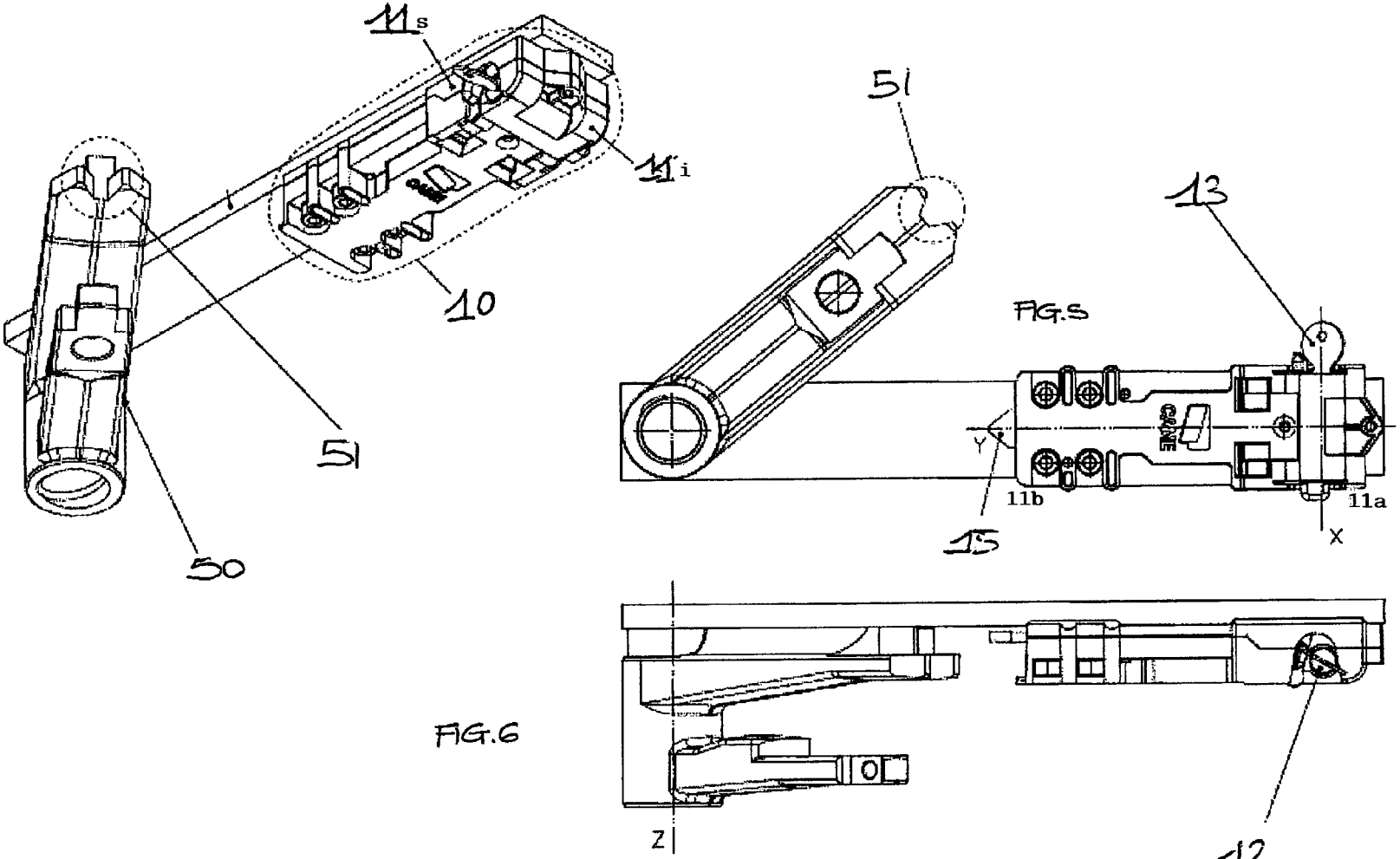
FIGS. 4-6 show a set of views of the drive element-driven element system in a second opening configuration.

Referring now to FIGS. 1-3, reference numeral 10 designates as a whole a gate lock.

Lock 10 comprises a body 11 with un upper part 11*s* and a lower part 11*i*, which house a latch 12, for a customized or three-lobed key, arranged along a first axis X of the lock, within which a customized or three-lobed key 13 can turn. The opening for the key 13 is therefore preferably positioned on one side of body 11 of lock 10.

Latch 12 is mounted on a first end 11*a* of the body of lock 10, opposite to a second end 11*b* from which a stop element 14 protrudes which, when in operation, can lock a lever 50 (drive element), which in operation is integral with the motoreducer and rotates about a second axis Z orthogonal to the first axis X, thus allowing the rotary movement of the gate fitting integral with the wing (driven element), on which the lock 10 is mounted; stop element 14 comprises a first configuration (idle configuration), wherein it engages with at least a part of the drive element, and a second configuration (opening configuration), wherein it is not engaged with any part of the drive element.

Stop element 14 is slidable with respect to lock 10 that houses it; more in detail, it slides constrained between the inner surfaces of lower part 11*i*, which act as a guide for said element.

The sliding direction of stop element 14 is parallel to a third axis Y, orthogonal to both axis X and axis Z.

Stop element 14 is forced to slide towards second end 11*b* of lower body 11*i* because of the presence of an elastic retention element 14*e*, which in the annexed drawings is shown as a spring, but may likewise be replaced with any equivalent element.

Stop element 14 comprises a rear terminal part 14*p* on which a retraction element 16 is pivoted, also slidable with respect to lower body 11*i* along third axis Y. Retraction element 16 is constrained to slide, which is pushed towards second end 11*b* of lock 10 by a pair of springs 18 oriented parallel to third axis Y and parallel to each other. Retraction element 16 is therefore positioned between slide 17 and stop element 14.

Springs 18 have, respectively:

- a first end constrained to first end 11*a* of lower body 11*i* of lock 10; and
- a second end constrained to slide 17;

and are guided by respective spring guide seats obtained on slide 17 to ensure that they are compressed axially.

Thanks to the mutual constraint between springs 18 and slide 17, both retraction element 16 and stop element 14 are pushed towards second end 11*b* of lock 10 when key 13 is not in latch 12 or, alternatively, when it has been inserted therein but has not been turned. This condition corresponds to a first configuration (idle configuration) of lock 10.

Slide 17, which is also slidable along third axis Y, and which is subjected to the thrust force exerted by springs 18, is guided by a lowered portion obtained in upper part 11*s* of lock 10, whose surfaces are oriented parallel to third axis Y.

As shown in the annexed drawings, the lock according to the present invention further comprises a pair of latching levers 18*a* and 18*b*, respectively:

- 18*a*: locking lever, with one end pivoted into a seat 17*f* of slide 17;
- 18*b*: re-latching lever, with one end pivoted on a pivot pin 11*if* of lower body 11*i;* wherein both levers can oscillate about respective fulcrums having axes parallel to axis Z, and are positioned inside lower body 11*i*, substantially near retraction element 16. Both latching levers 18*a*, 18*b* are equipped with the following:

- 18*a*: a spring 18*am* having a first end constrained to an undercut of slide 17 and a second end pressing against the lever itself;

18*b*: a spring 18*bm* having a first end constrained onto a surface of lower body 11*i* and a second end pressing against the lever itself.

The above-mentioned springs can therefore push latching levers 18*a* and 18*b* one towards the other; the latter are designed to get into the following:

18*a*: a protuberance 11*ip* of lower body 11*i;*

18*b*: a recess or notch 17*r* of slide 17.

More in detail, said protuberances/notches 11*ip* and 17*r* selectively interact with the free ends of each latching lever 18*a*, 18*b*.

The selective interaction of the latching levers is achieved through a guide lever 15 sliding along third axis Y, which is guided by a lowered portion obtained in element 19, referred to as spring holder, constrained to lower body 11*i* of lock 10. In detail, guide lever 15 protrudes, when fully extended, out of second end 11*b* of lock 10 under the thrust exerted by a spring 15*m*, oriented parallel to third axis Y; this condition occurs in the opening configuration, i.e. when stop element 14 is released from a recess 51 of lever 50.

Consequently, in the idle configuration guide lever 15 is in the position of minimal extension out of second end 11*b*.

Therefore, all the elements of lock 10, except for upper body 11*s*, lower body 11*i*, latching levers 18*a* and 18*b*, latch 12 and respective key 13, move along third axis Y.

As aforementioned, in a first configuration—or idle condition—lock 10 is in a configuration wherein lever 50 is locked, with stop element 14 inserted in a recess 51 of lever 50 (which recess is located in a position opposite to the point where the lever is pivoted on second axis Z).

Figure 7:
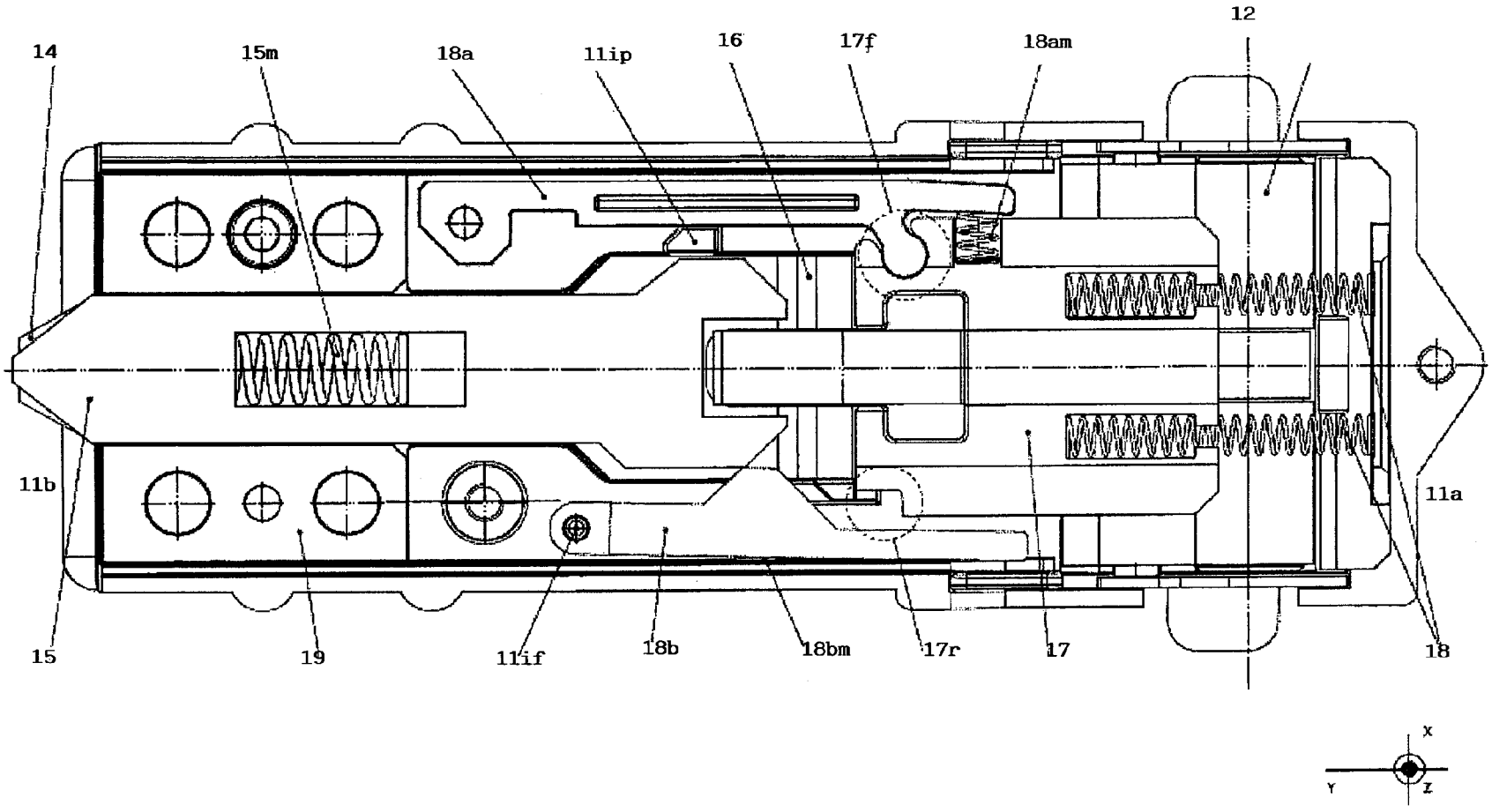
FIG. 7 is a top view of a portion of the lock according to the present invention in the first idle configuration.
Figure 8:
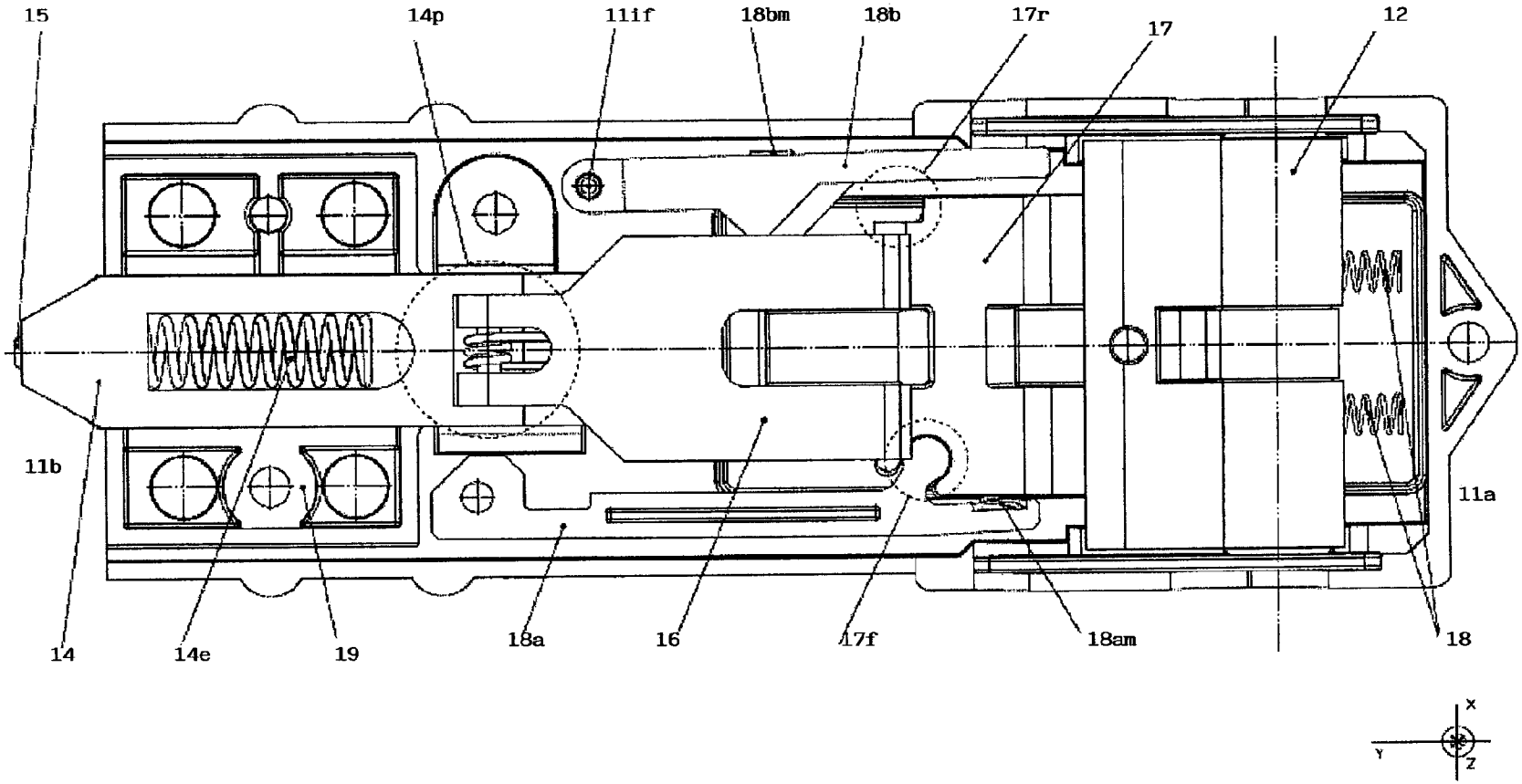
FIG. 8 shows a bottom view of a portion of the lock in the first idle configuration.

As shown in FIGS. 7 and 8, in the first configuration (idle configuration) springs 18 are fully extended, and therefore both stop element 14 and retraction element 16 are pushed towards second end 11*b* of lock 10. In particular, stop element 14 comes out of second end 11*b* of lock 10. Slide 17 is also directly pushed by springs 18 towards said second end 11*b* of lock 10.

Figure 9:
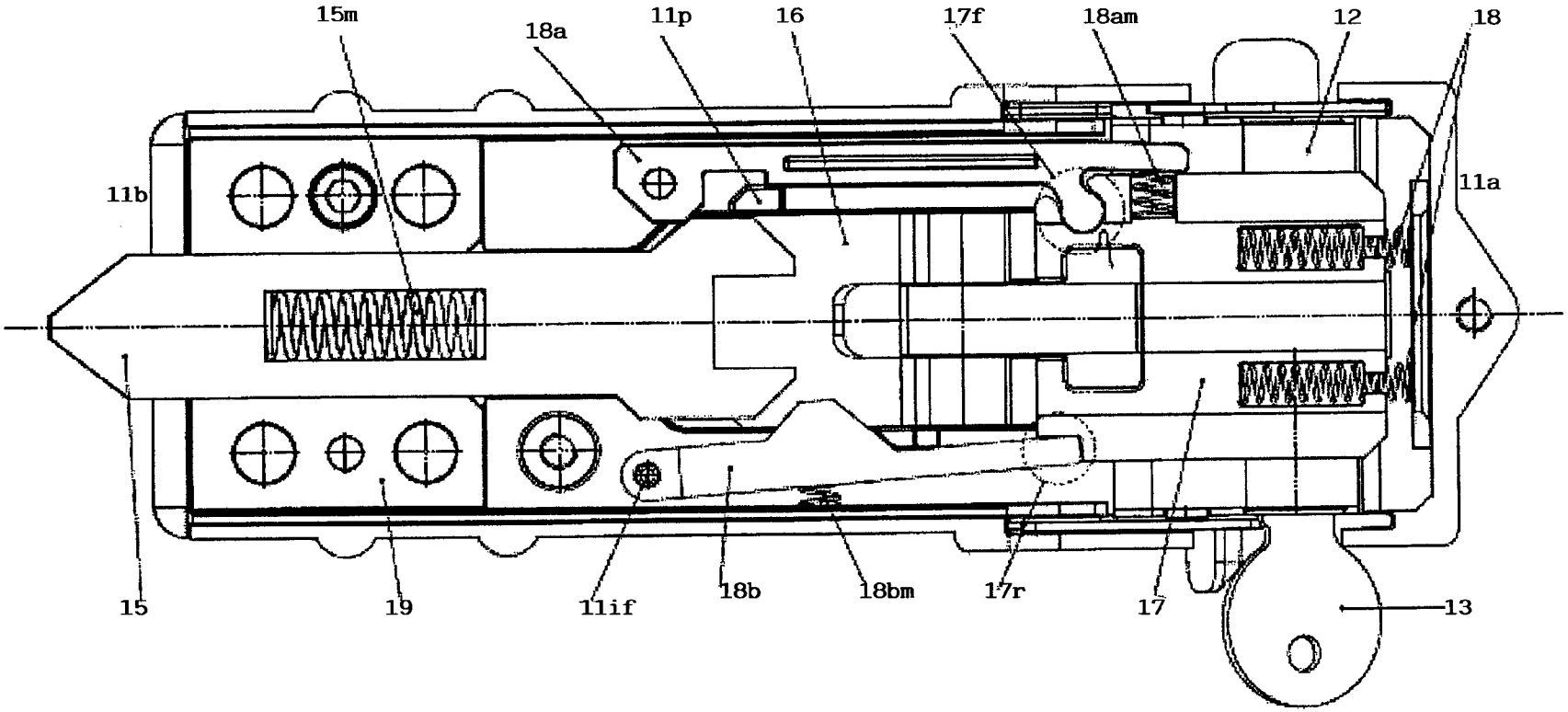
FIG. 9 is a top view of a portion of the lock 10 in the second opening configuration.
Figure 10:
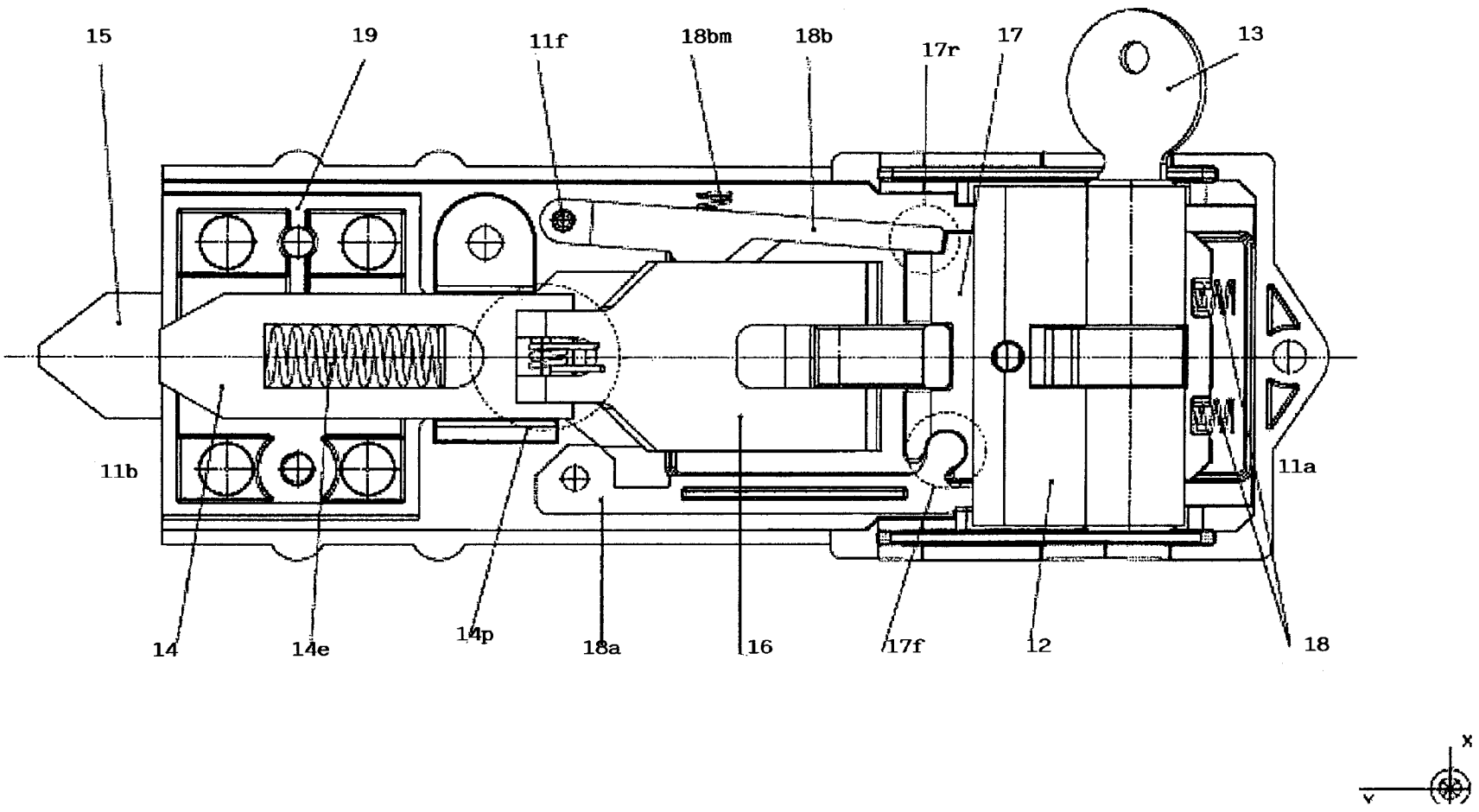
FIG. 10 is a bottom view of a portion of the lock 10 in the opening configuration.

On the contrary, FIGS. 9 and 10 show that, when key 13 is turned inside the latch 12, the lock 10 of the present invention is set to a second configuration (opening configuration), wherein stop element 14 is slid along third axis Y towards first end 11*a* of lower body 11*i* of lock 10; as a consequence, lever 50 becomes free to rotate about axis Z; as a result, a swing gate (driven element) on which lock 10 has been installed, and previously constrained to lever 50, can be opened or, alternatively, closed independently of the drive element.

In the second configuration, stop element 14 and retraction element 16 are fully retracted towards first end 11*a* of lower body 11*i* of lock 10. As a consequence, slide 17 also slides back towards first end 11*a* of upper body 11*s* (guided by a lowered portion obtained in the upper body 11*s*), while springs 18 are both fully compressed.

Finally, it is clear that, although a lock 10 capable of locking a lever 50 of an automatic gate has been described so far, lock 10 can also lock at least a part of any gate.

The advantages of lock 10 are apparent in the light of the above description. In particular, it ensures a more reliable opening action, avoiding that lever 50 might fail to unlock after turning key 13 in latch 12.

In addition, the fact that the lock according to the present invention is made up of a limited number of components ensures a lower risk of failures related to a malfunction of a single component of vital importance for locking or unlocking it.

Also, the fact that stop element 14, retraction element 16 and slide 17 all move in a substantially axial direction brings the advantage that the slide can slide very smoothly, without the risk of seizure due to linkages moving in oblique directions. This advantage is especially manifest when the lock is seldom used.

Furthermore, the lowered portion obtained in upper body 11*s* improves the sliding action of slide 17 along upper body 11*s*.

Although no numerical indications are provided herein about the strength of the springs, it is clear that the man skilled in the art will select springs having adequate strength depending on the traction that can be exerted by key 13 and on the overall dimensions of the lock itself.

The device described herein may be subject to a number of variations, modification and additions which will be obvious to those skilled in the art.

The invention claimed is:

1. A gate lock configured for engaging a gate, the lock comprising:

a body, the body comprising a latch that can house a key for opening said lock and a stop element having a first configuration configured to engage at least a part of a gate;

a slide, which slides with respect to said body, and said stop element slidably constrained to a guide element;

a retraction element, which slides with respect to the body, wherein said stop element comprises a rear part on which said retraction element is pivoted; and a plurality of springs, wherein said retraction element is constrained to the slide of said lock, said slide being subjected to a thrust force by said plurality of springs.

2. The lock according to claim 1, wherein said body comprises a first end and a second end, and wherein in a first idle configuration said stop element is forced in the direction of said second end.

3. The lock according to claim 2, further comprising an elastic retention element forcing said stop element.

4. The lock according to claim 1, further comprising a first latching lever and a second latching lever which have a respective end pivoted on a respective pivot pin and rotating about an axis orthogonal to a direction of movement of said stop element.

5. The lock according to claim 4, wherein said first latching lever comprises an end pivoted on a seat of said slide.

6. The lock according to claim 4, wherein said second latching lever comprises an end pivoted on said body.

7. The lock according to claim 4, wherein each of said two first and second latching levers is subjected to a force exerted by a respective spring.

8. The lock according to claim 1, further comprising a guide lever partially coming out of said body.

9. The lock according to claim 1, comprising an idle configuration in which said springs are substantially released and said stop element is pushed towards a second end.

10. The lock according to claim 9, further comprising an opening configuration in which said springs are substantially tensioned said stop element is retracted from said second end.

11. The lock according to claim 8, wherein in an opening configuration said guide lever extends maximally out of a second end of said body and releases said stop element from a recess of a lever.

12. The lock according to claim 8, wherein in an idle configuration said guide lever extends minimally out of a second end of said body.

* * * * *